US010132568B2

(12) United States Patent
Singh et al.

(10) Patent No.: US 10,132,568 B2
(45) Date of Patent: Nov. 20, 2018

(54) DRY COOLING SYSTEM FOR POWERPLANTS

(71) Applicant: Holtec International, Marlton, NJ (US)

(72) Inventors: Krishna P. Singh, Hobe Sound, FL (US); Vytautas Vincas Maciunas, Cherry Hill, NJ (US); Indresh Rampall, Cherry Hill, NJ (US)

(73) Assignee: HOLTEC INTERNATIONAL

( * ) Notice: Subject to any disclaimer, the term of this patent is extended or adjusted under 35 U.S.C. 154(b) by 164 days.

(21) Appl. No.: 15/243,180

(22) Filed: Aug. 22, 2016

(65) Prior Publication Data

US 2017/0051980 A1 Feb. 23, 2017

Related U.S. Application Data

(60) Provisional application No. 62/207,674, filed on Aug. 20, 2015.

(51) Int. Cl.
*F28B 1/06* (2006.01)
*F28F 9/02* (2006.01)
(Continued)

(52) U.S. Cl.
CPC ..... *F28B 1/06* (2013.01); *F28B 1/02* (2013.01); *F28B 9/06* (2013.01); *F28D 1/05366* (2013.01); *F28F 9/0243* (2013.01); *F28F 9/262* (2013.01)

(58) Field of Classification Search
CPC ..... F28B 1/06; F28B 1/02; F28B 9/06; F28B 1/00; F28F 9/262; F28F 9/024;
(Continued)

(56) References Cited

U.S. PATENT DOCUMENTS 3,831,667 A * 8/1974 Kilgore ..... F01K 9/003 165/96
3,881,548 A 5/1975 Budenholzer
(Continued)

FOREIGN PATENT DOCUMENTS

| | | |
|---|---|---|
| CN | 101936669 | 1/2011 |
| CN | 104279884 | 1/2015 |
| WO | 2013081148 | 4/2015 |

OTHER PUBLICATIONS

Wurtz, William, "Air-cooled condensers eliminate plants water use", Power Business & Technology for the Global Generation Industry Since 1882, http://www.powermag.com/air-cooled-condensers-eliminate-plant-water-use/?printmode=1, Sep. 15, 2008, pp. 1-11. US.

(Continued)

*Primary Examiner* — Ana Vazquez
(74) *Attorney, Agent, or Firm* — The Belles Group, P.C.

(57) ABSTRACT

An indirect dry cooling system suitable for steam condensing applications in a power plant Rankine cycle includes an air blast chiller having a plurality of interconnected modular cooler cells. Each cell includes a blower and tube bundle including inlet headers, outlet headers, and plurality of tubes extending between the headers. In one embodiment, the tube bundles form an A-frame cell construction being structurally self-supporting from a base. Each of the tubes may be finned. Cooling water circulating in a closed flow loop on the tube side between the air blast chiller and turbine steam condenser is cooled by ambient air blown through the tube bundles. The cooled water flows through a second tube bundle in the condenser which condenses steam. The heated cooling water returns through the air blast chiller to complete the cooling water cycle.

19 Claims, 13 Drawing Sheets

(51) Int. Cl.

| | |
|---|---|
| ***F28F 9/26*** | (2006.01) |
| ***F28B 1/02*** | (2006.01) |
| ***F28B 9/06*** | (2006.01) |
| ***F28D 1/053*** | (2006.01) |

(58) Field of Classification Search
CPC ..... F28F 27/02; F28D 1/05366; F01K 9/003; B01D 5/0009; F24D 9/00
See application file for complete search history.

(56) References Cited

U.S. PATENT DOCUMENTS

| | | | | |
|---|---|---|---|---|
| 3,976,126 | A | 8/1976 | Ruff | |
| 4,129,180 | A | 12/1978 | Larinoff | |
| 4,657,070 | A | 4/1987 | Houston | |
| 4,949,543 | A | 8/1990 | Cottone et al. | |
| 5,490,559 | A | 2/1996 | Dinulescu | |
| 5,613,554 | A * | 3/1997 | Bull | F24F 13/22 165/122 |
| 6,276,443 | B1 | 8/2001 | Martin, Sr. | |
| 6,474,272 | B2 | 11/2002 | Bensing et al. | |
| 7,946,338 | B2 | 5/2011 | Szabo | |
| 8,320,750 | B2 | 11/2012 | Han et al. | |
| 8,833,098 | B2 | 9/2014 | Wiggs | |
| 2008/0093051 | A1 | 4/2008 | Rios et al. | |
| 2010/0263840 | A1 | 10/2010 | Nobel | |
| 2013/0292103 | A1 | 11/2013 | Eindhoven | |
| 2014/0150994 | A1 | 6/2014 | Singh et al. | |
| 2014/0367243 | A1* | 12/2014 | Kroger | F28B 1/06 202/161 |
| 2015/0377559 | A1 | 12/2015 | Csaba et al. | |

OTHER PUBLICATIONS

International Atomic Energy Agency, Efficient Water Management in Water Cooled Reactors, IAEA Nuclear Energy Series No. NP-T-2.6, Nov. 5, 2012, http://www-pub.iaea.org/MTCD/Publications/PDF/P1569_web.pdf.

International Search Report and Written Opinion for PCT/US2016/048022 dated Oct. 25, 2016.

* cited by examiner

DRY COOLING SYSTEM FOR POWERPLANTS

CROSS-REFERENCE TO RELATED APPLICATIONS

The present application claims the benefit of priority to U.S. Provisional Application No. 62/207,674 filed Aug. 20, 2015, which is incorporated herein by reference in its entirety.

BACKGROUND

The present invention generally relates to dry cooling systems, and more particularly to an indirect air-cooled dry cooling system suitable for steam condensing applications in a Rankine cycle of an electric generating power plant.

Power plants are voracious consumers of water which requires them to be sited next to a natural body of water such as a lake, a river or sea. For every kilowatt of electricity produced, a power plant rejects between 1.5 to 2 kW of waste heat to the environment. Thus a 1000 MWe (electric) plant rejects at least 1500 Mw of heat to the environment, usually through a cooling tower. This amounts to approximately 10,000 gallons of water evaporated per minute in the cooling tower. Air cooled condensers (ACCs) have occasionally been used to alleviate this burden on the environment. An ACC condenses the exhaust waste steam by directing it into the tubes of finned tube bundles and by blowing air across the tube bundles arrayed at an oblique angle to the vertical. Thus the waste heat from the low pressure steam is directly rejected to the ambient air. The ACC assumes the role of the steam surface condenser and the cooling tower. ACCs unfortunately have not achieved wide industry acceptance because of several factors, among them:

a. The ducts needed to deliver the (low pressure) waste steam tend to be quite large; diameters in excess of 20 feet are often necessary. Accommodating such a large pipe in the plant poses a multitude of technical challenges.

b. The footprint of the ACC is quite large; a 600 MWe plant, for example, requires a footprint of over 100,000 square feet.

c. Because the ambient air temperature is usually greater than the temperature of the natural water source in the summer months, the condenser back pressure operated by an ACC is generally higher than the classical cooling tower set up, detracting from the plant's power output.

d. Because of technology limitations, ACCs have historically been built from carbon steel tubes which put the condensate directly in contact with the iron species posing the risk of iron carry over in the condensate and an adverse impact on the power plant's service life.

For a new power plant, incorporating an ACC in the plant's design in lieu of a water cooled surface condenser is in most cases quite feasible technically but usually commercially non-competitive. In an operating plant on the other hand, because of the reasons mentioned above, installing an ACC is an extremely disruptive and usually cost-prohibitive undertaking. The alternative configuration described below, seeks to overcome the ACC's shortcomings, making the switch to air cooling feasible for most operating plants and serving as a credible alternative to the cooling tower or ACC options for new power plants.

An improved air-cooled steam condensing system is desired.

SUMMARY

The present disclosure provides an air-cooled heat exchanger which in one non-limiting application may operate in an indirect air-cooled dry cooling system adapted for use in turbine exhaust steam condensing service of a power generation plant. The non-limiting embodiment disclosed herein is referred to as an air blast chiller (ABC). One key distinguishing feature of the ABC is that instead of passing the turbine exhaust steam through the finned tubes and condensing it by blasting air across the tubes that occurs in an air cooled condenser (ACC), the ABC cools cooling water circulating in a pumped closed flow loop, which in turn condenses the steam in an existing or new water cooled condenser (WCC) that receives exhaust steam from the lower pressure section of a steam turbine in a turbine-generator set. In contrast to the ACC, the plant's WCC (also referred to as a surface condenser) the cooling water thus extracts the latent heat of the exhaust steam in the WCC and releases it to the ambient air flowing through the ABC. The cooling water system provides a heat sink for cooling the higher temperature steam in the WCC, while the ambient air provides a heat sink for the higher temperature cooling water. Unlike a condenser served by a natural body of water or cooling tower, the cooling water is clean circulating in a closed loop which protects the condenser tubes from fouling (which is endemic to WCCs served by a natural water source and to some degree with cooling towers). Thus, the air blasted through the ABC, in lieu of the evaporating water in the cooling tower, becomes the ultimate dump of the plant's waste heat.

Aspects of an air blast chiller according to the present disclosure includes the following. The ABC may be a single row finned tube heat exchanger arranged in the shape of an A-frame in one configuration with an included angle formed between opposing walls or panels of tube (i.e. tube bundles).

The sloped surfaces of the ABC A-frame may each comprise a single layer of tightly packed and linearly arranged obround or rectangular shaped tubes without any appreciable gaps between fins of adjoining tubes that might enable upflowing air to readily bypass the tubes without contact with the fins. Thus the surface of the "roof" is preferably thermally opaque except for the narrow slits defined by and between the single row of fins affixed to the opposing flat surfaces of the obround/rectangular tubes on each side.

Each of the two sloped surfaces (e.g. "roof") of the ABC is actually made of a number of discrete "tube bundles;" each bundle defined by a number of straight finned tubes (typically 30 to 50 in number) in one non-limiting configuration joined to a common inlet and outlet headers at each extremity of the tube bundles. The inlet (e.g. bottom) and outlet (e.g. top) headers of the bundles in each side of the roof (which are co-axial by virtue of the layout) are concatenated in arrangement and their contiguous ends are fastened together by any suitable mechanical joining mechanism. Thus the ABC "cooling cell" in one non-limiting embodiment may comprise two flow headers at the top and two flow headers at the bottom.

However, the cooling water flow in each header may not be unidirectional in some embodiments. Rather, the cooling water flow received in the bottom header from the water-cooled condenser may be directed to flow upwards inside the tubes (tube side) along the length of the tubes and tube bundle to the top header at the other extremity, where it in turn passes to the next top header which directs the flow back downwards in the reverse direction. This flow arrangement, known as a multi-pass or multiple pass layout in heat exchanger nomenclature, may be an essential feature of some ABCs according to the present disclosure required by the small volumetric flow of water and the need to maintain a high in-tube or tube side water velocity. In one representative example, the cooling water velocity preferably may be in the range from and including 4 to 10 feet per second.

The foregoing aspects are further described herein.

In one embodiment, a dry cooling system for condensing steam includes: a condenser arranged to receive exhaust steam from a steam turbine; a condenser tube bundle disposed in the condenser; and an air blast chiller fluidly coupled to the condenser tube bundle via a cooling water closed flow loop for circulating cooling water. The air blast chiller comprises a plurality of fluidly interconnected cooling cells each comprising: a pair of first and second inlet bundle section headers fluidly coupled to the closed flow loop; a pair of first and second outlet bundle sections headers fluidly coupled to the closed flow loop; a first tube bundle comprising a plurality of spaced apart tubes fluidly coupled between the first inlet and outlet bundle section headers; a second tube bundle angularly oriented to the first tube bundle and comprising a plurality of spaced apart tubes fluidly coupled between the second inlet and outlet bundle section headers; the first and second outlet bundle section headers disposed laterally adjacent to each other, and the first and second inlet bundle section headers spaced laterally apart from each other; and an air blower arranged to blow ambient cooling air through the first and second tube bundles; wherein hot cooling water from the condenser tube bundle flows through the closed flow loop to each of the first and second inlet bundle section headers, through the first and second tube bundles wherein the cooling water is cooled, the cooled cooling water collected in the first and second outlet bundle section headers and flowing through the closed flow loop back to the condenser tube bundle.

In one embodiment, an air blast chiller for condensing steam includes: a plurality of fluidly coupled cooling cells arranged in a contiguous row of adjoining fluidly interconnected cooling cells, each cooling cell comprising: a first half section including a first inlet header, a first outlet header, and a first tube bundle comprising a plurality of linearly spaced apart finned tubes fluidly coupled between the first inlet and outlet headers; and a second half section including a second inlet header, a second outlet header, and a second tube bundle comprising a plurality of linearly spaced apart finned tubes fluidly coupled between the second inlet and outlet headers; the first half section arranged at an acute angle to the second half section wherein the first and second outlet headers are disposed proximately to each other, and the first and second inlet headers are disposed distally to each other forming a triangular configuration; and a blower arranged and operable to blow ambient cooling air through the first and second tube bundles.

A method for condensing steam is provided. In one embodiment, the method includes: providing an air blast chiller including: a plurality of fluidly coupled cooling cells arranged in a contiguous row of adjoining fluidly interconnected cooling cells, each cooling cell comprising: a first half section including a first inlet header, a first outlet header, and a first tube bundle comprising a plurality of linearly spaced apart finned tubes fluidly coupled between the first inlet and outlet headers; and a second half section including a second inlet header, a second outlet header, and a second tube bundle comprising a plurality of linearly spaced apart finned tubes fluidly coupled between the second inlet and outlet headers; the first half section arranged at an acute angle to the second half section wherein the first and second outlet headers are disposed proximately to each other, and the first and second inlet headers are disposed distally to each other forming a triangular configuration; and a blower arranged and operable to blow ambient cooling air through the first and second tube bundles; receiving hot cooling water from a steam condenser in the first and second inlet headers of a first cooling cell; flowing the cooling water through the first and second tube bundles in a first direction, wherein the cooling water is cooled a first time; collecting the cooling water in the first and second outlet headers of the first cooling cell; transferring the cooling water to the first and second outlet headers of a second cooling cell; flowing the cooling water through the first and second tube bundles of the second cooling cell in a second first direction opposite the first direction, wherein the cooling water is cooled a second time; collecting the cooling water in the first and second inlet headers of the second cooling cell; and transferring the cooling water to the first and second inlet headers of a third cooling cell.

BRIEF DESCRIPTION OF THE DRAWINGS

The features of the preferred embodiments will be described with reference to the following drawings where like elements are labeled similarly, and in which.

All drawings are schematic and not necessarily to scale. A reference herein to a figure number herein that may include multiple figures of the same number with different alphabetic suffixes shall be construed as a general reference to all those figures unless specifically noted otherwise.

DETAILED DESCRIPTION

Figure 1:
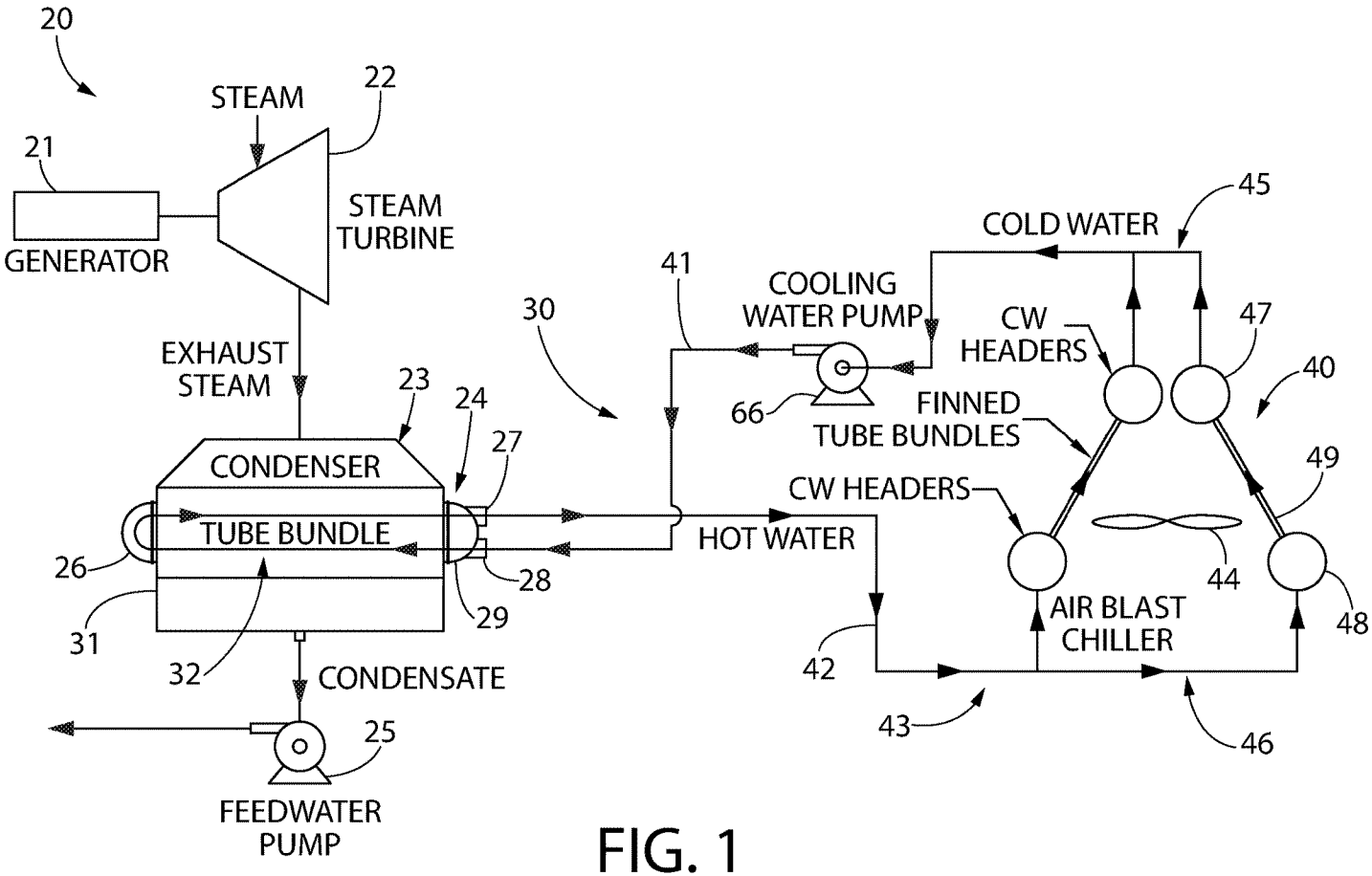
FIG. 1 is schematic flow diagram of an air-cooled dry cooling system.

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

FIG. 1 is a flow diagram of an air-cooled drying cooling system 30 according to the present disclosure in a steam condensing application of a power plant operating on a Rankine cycle. The electric power generating portion of the plant comprises a turbine-generator set 20 including an electric generator 21 and steam turbine 22 operably coupled to the generator for rotating a rotor. A steam generator (not shown) heats feedwater to produce the steam. In various embodiments, the source of heat for the steam generator may be a nuclear reactor, or a furnace which burns a fossil fuel such as coal, oil, shale, gas, biomass, etc. The heat and fuel source do not limit the invention. The air blast chiller 40 may be incorporated in the power plant to either supplant or supplement an evaporative system employing a cooling tower.

The steam side of the plant equipment further includes a water-cooled surface condenser 23 which receives exhaust steam from the low pressure section of the turbine 22. A heat exchanger tube bundle assembly 24 comprising a tube bundle 32 having a plurality of heat transfer tubes 26 is mounted in the condenser below the neck in any suitable orientation. The tubes extend substantially from one side the condenser shell 31 to an opposite side. In one non-limiting embodiment, the bundle may be oriented horizontally. The tube bundle assembly 24 further comprises a cooling water inlet nozzle 28 and an outlet nozzle 27 fluidly and physically coupled to an exposed head 29 of the tube bundle assembly positioned outside the condenser shell 31. The head 29 forms an interior channel or flow plenum for receiving and discharging cooling water.

Any type, metallic material, and configuration of tubes 26 suitable for the heat transfer application may be used such as U-bend tubes as illustrated or straight tubes with a return header provided on a distal end of the tube bundle opposite from the head 29. The tube bundle 32 extends internally inside and through the shell 31 of the condenser 23. A two-pass tube arrangement is provided by the U-shaped tubes in which cooling water traverses the width of the condenser shell 31 from side to side twice. Other numbers of passes may be used depending on the heat transfer duty sufficient to condense the steam. The condensed steam is collected in a hotwell in the bottom of the condenser 23 from which a feedwater pump 25 takes suction for returning the feedwater to the steam generator for heating and conversion into steam again, thereby completing the steam cycle water flow loop.

The cooling system 30 includes an air-cooled heat exchanger in the form of an air blast chiller (ABC) 40. In one embodiment, the cooling system 30 defines a cooling water closed flow loop 43 formed by a cooling water pump 66 and flow conduits comprising a cold fluid flow conduit 41 (or "cold leg") which receives cooled cooling water discharged by the air blast chiller for condensing steam and a hot fluid flow conduit 42 (or "hot leg") which transports heated cooling water from the condenser 23 heated by the steam to the chiller for cooling, thereby completing the cooling cycle flow loop 43. It bears noting that the cooling water flowing inside the closed flow loop 43 is physically and fluidly isolated from the steam flowing through condenser 23. Flow conduits 41, 42 may be formed by piping of suitable diameter and material appropriate for the service conditions encountered.

Figure 2:
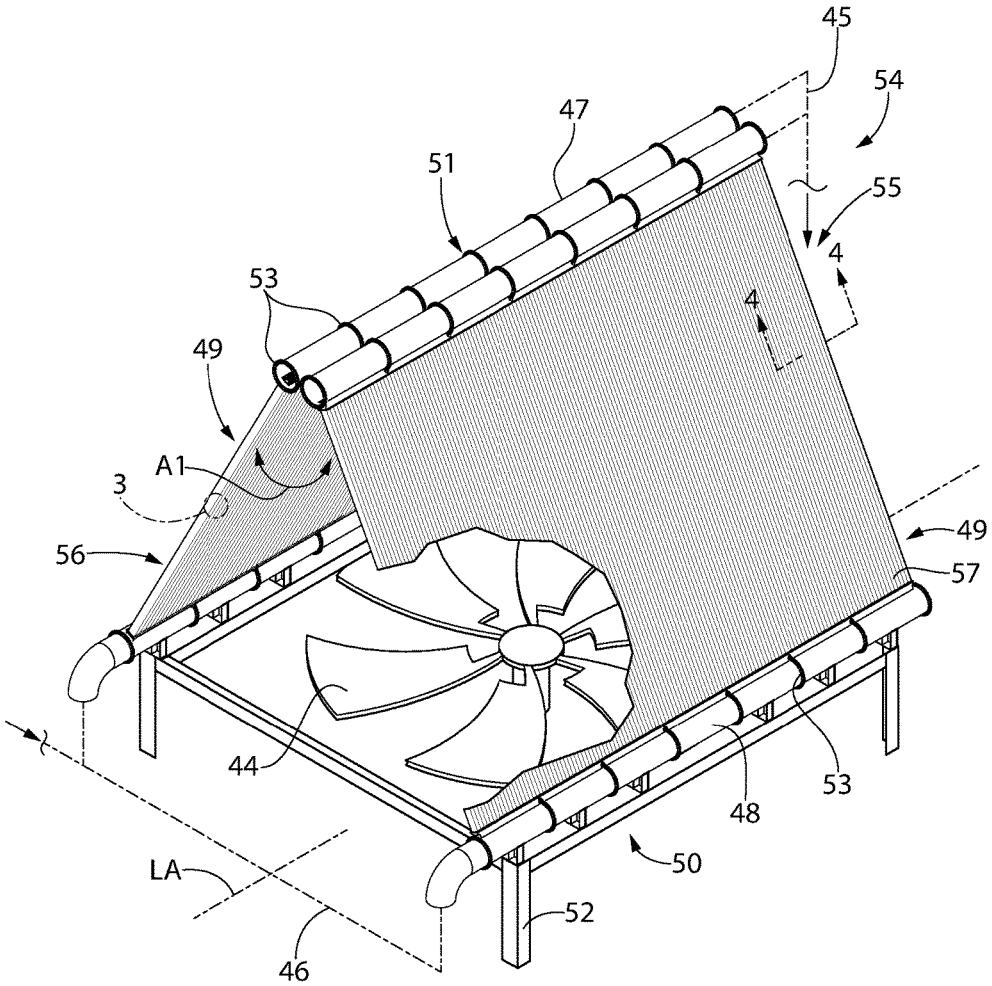
FIG. 2 is a perspective view of the air blast chiller of FIG. 1.
Figure 3:
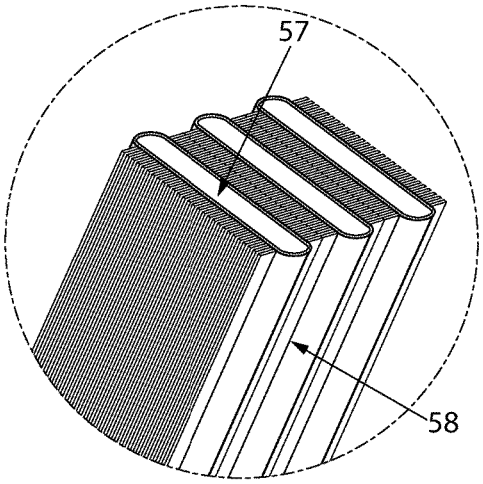
FIG. 3 is detail taken from FIG. 2 of the tube bundle showing some individual tubes.
Figure 4:
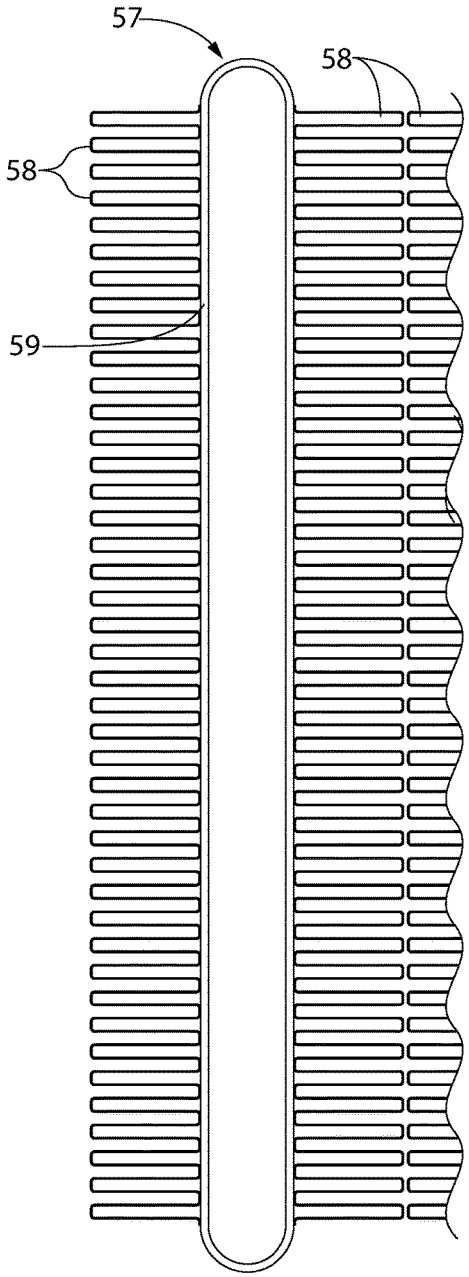
FIG. 4 is a cross sectional view taken from FIG. 2 of the tubes.
Figure 5:
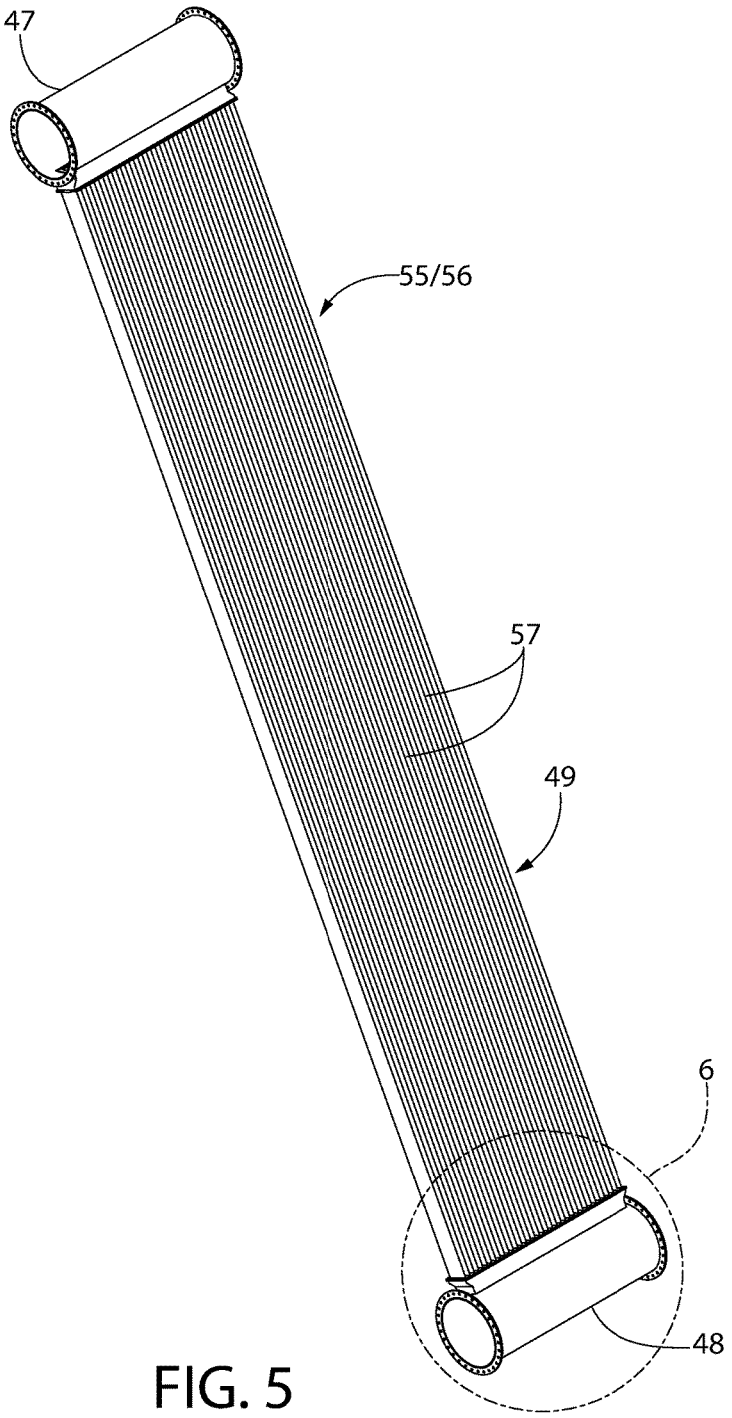
FIG. 5 is a perspective view of a half-section of the air blast chiller of FIG. 2 showing the tube bundle and inlet and outlet headers.
Figure 6:
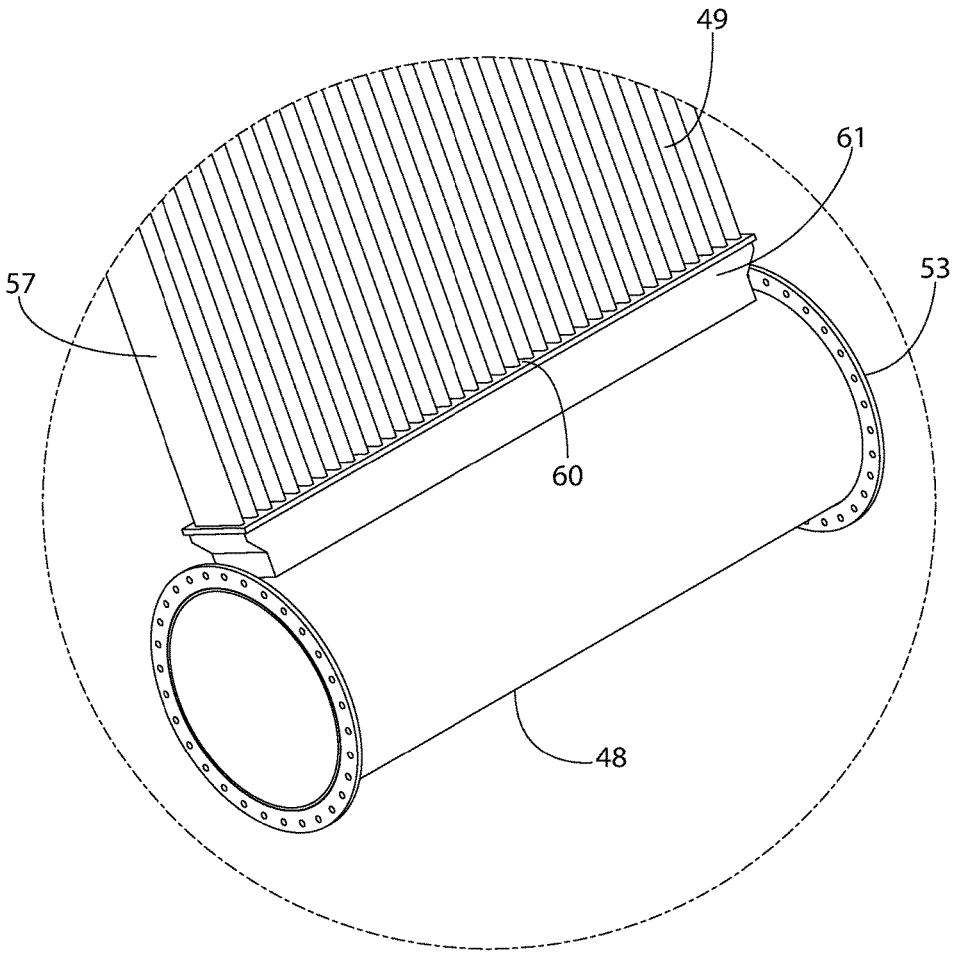
FIG. 6 is a detail taken from FIG. 5 of one of the headers.
Figure 7:
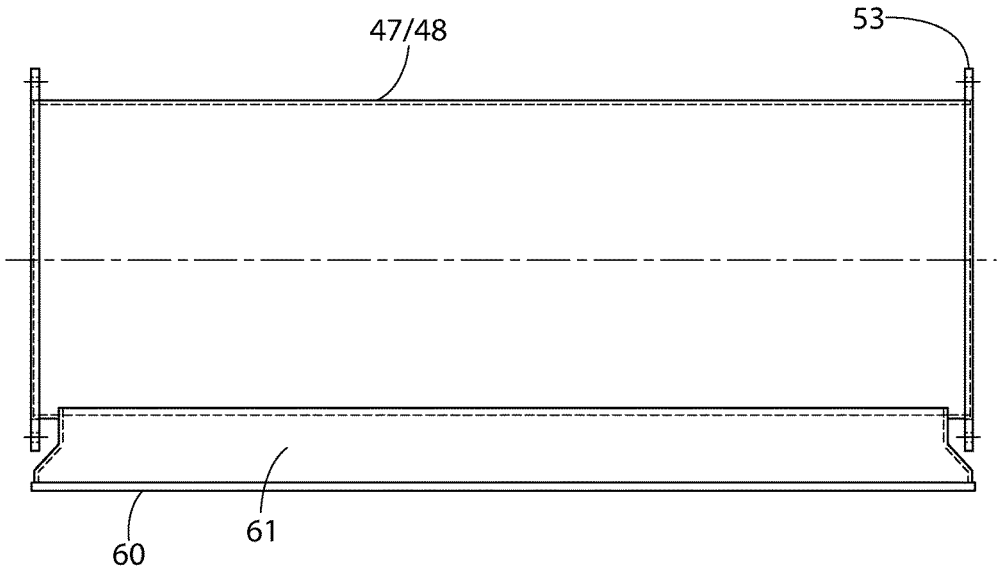
FIG. 7 is a side view of the top header of FIG. 5 showing the header manifold and tube sheet.
Figure 8:
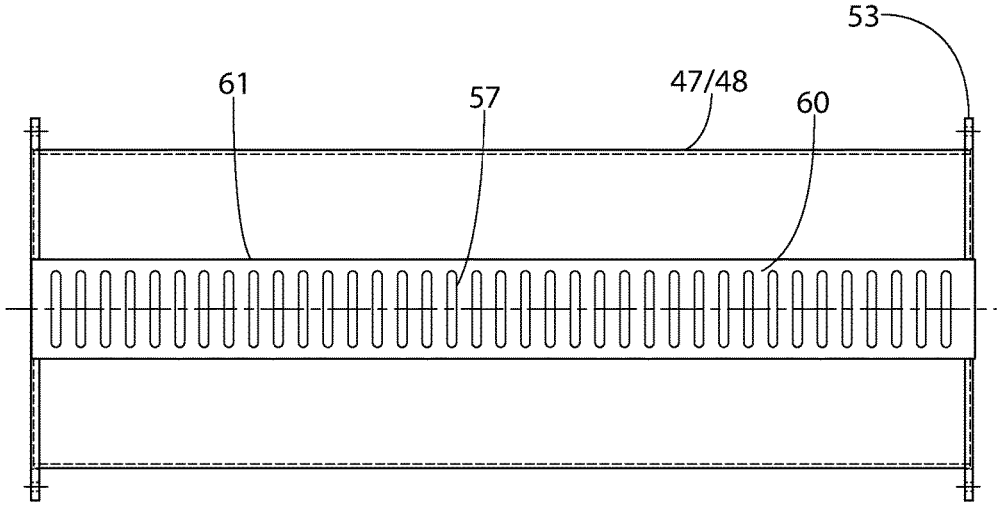
FIG. 8 is a bottom plan view thereof.
Figure 9:
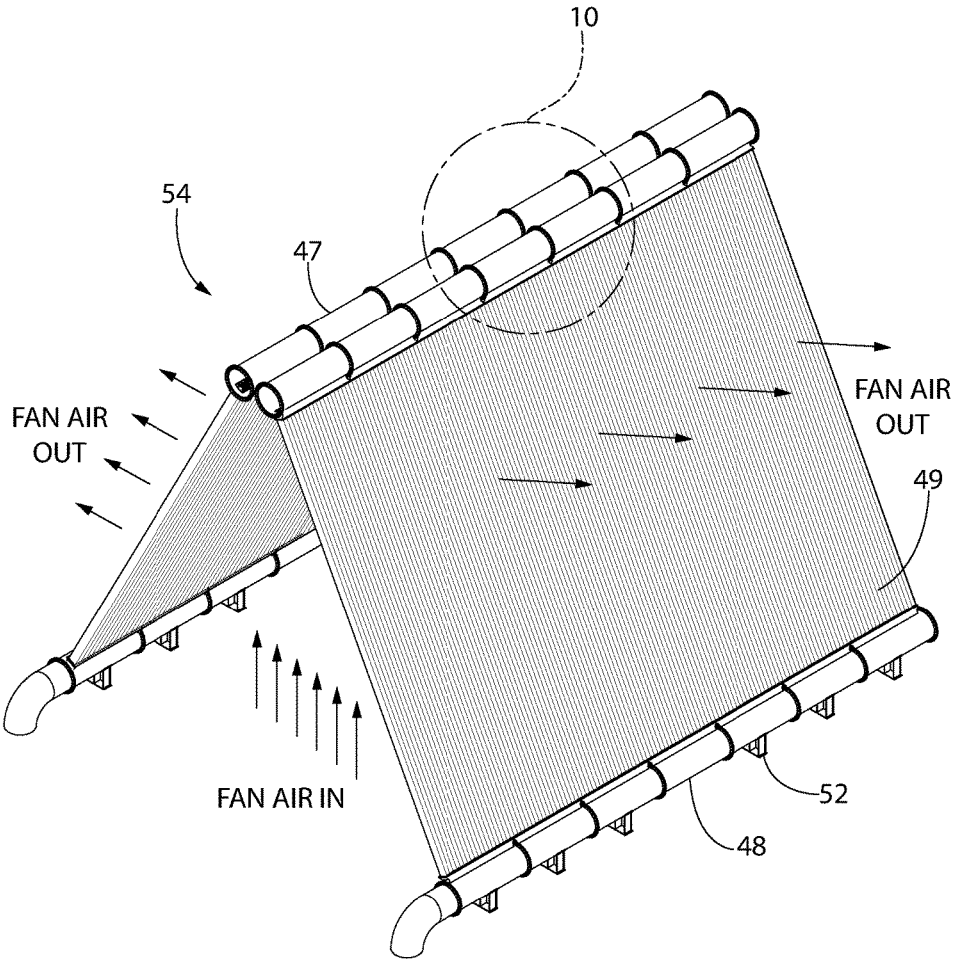
FIG. 9 shows the air blast chiller of FIG. 2 with the air flow pattern through the chiller indicated by directional flow arrows.
Figure 10:
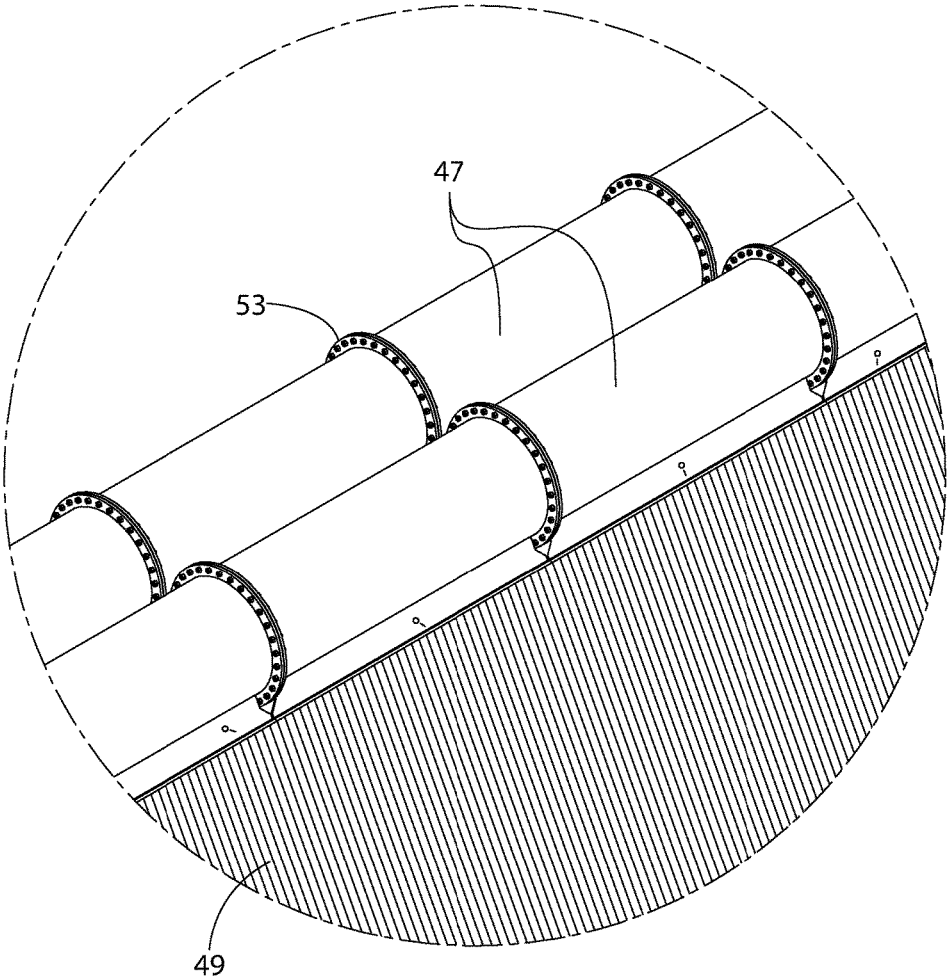
FIG. 10 is a detail taken from FIG. 9 showing the top headers.
Figure 11:
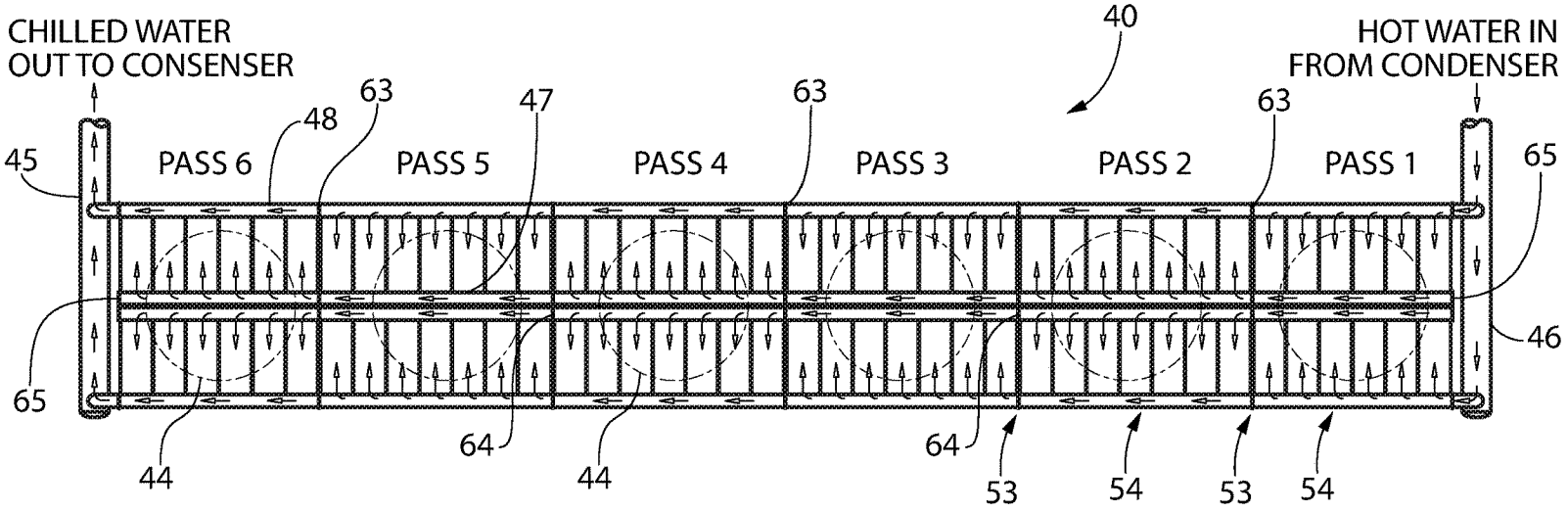
FIG. 11 is a top plan view showing a multiple tubeside pass air blast chiller comprised of a plurality of mechanically and fluidly interconnected cooling cells with cooling water tubeside flow pattern shown by directional flow arrows.
Figure 12:
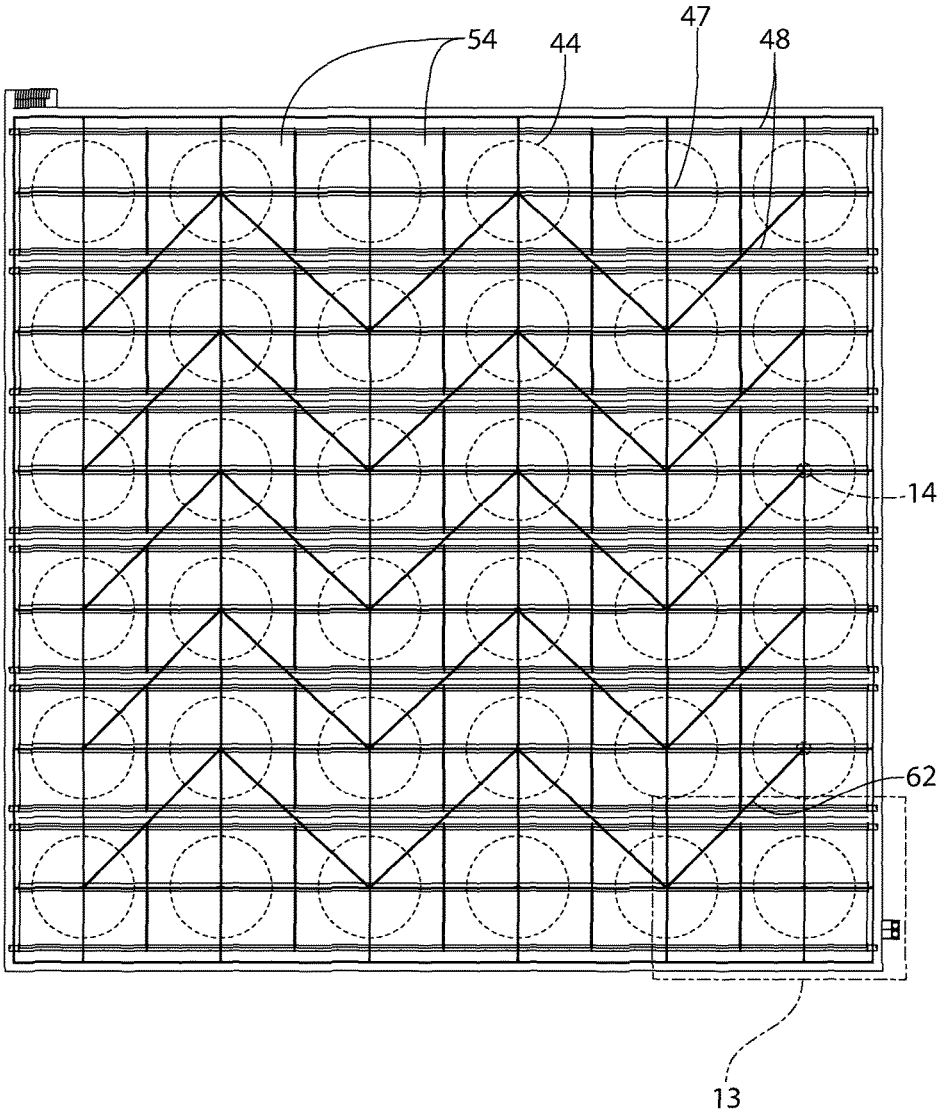
FIG. 12 is top plan view of an array of cooling cells forming an air blast chiller.

FIGS. 2-15 show further details of the air blast chiller 40. FIGS. 2 and 9 depict a single "cooling cell" 54 of the air blast chiller in air cooler nomenclature. A plurality of cooling cells may be physically and fluidly interconnected to form an array of cooling cells such as shown in FIGS. 11 and 12. The number of cells 54 will be dictated by the cooling capacity of the dry cooling system 30 required adequately cool the cooling water and condense steam in the condenser 23. In one embodiment, the array of cooling cells may be arranged in a single linear row, or multiple rows arranged parallel, perpendicularly, or obliquely to each other. There is no restriction on size or the contour of planform (footprint) of any subunit which is made of a number of cooling cells: The footprint may be rectangular or zagged. As the height of the bottom plenum is guided by the air suction needs of the blowers operating under the unit's roof, dividing the air blast chiller into multiple subunits separated from each other would result in a lower plenum height and thus an overall shorter chiller configuration. The invention is not limited by the cooling cell array configuration.

Referring to FIGS. 1-15, air blast chiller 40 includes a longitudinal axis LA, inlet flow plenum, an outlet inlet flow plenum, and a plurality of tube bundles 49 extending between the inlet flow plenum and the outlet flow plenum. In one preferred embodiment, the outlet flow plenum may be defined by a pair of cooling water outlet headers 47 and the outlet flow plenum may be defined by a pair of inlet headers 48. In other possible embodiments, the outlet flow plenum may comprise a single large header having a vertical longitudinal flow separation baffle extending down the center of the header for the entire length of the header to keep the tube bundle outflows fluidly separated for establishing two cooling water flow circuits or paths through the air blast chiller, as further described herein. The headers in one embodiment may be formed by piping.

The pairs of inlet and outlet headers 48, 47 may each be considered tube bundle section headers disposed at opposing ends of the tube arrays. In one arrangement, the inlet headers 48 may be bottom headers disposed at the bottom 50 of the air blast chiller closest to the ground or other flat horizontal support surface, and the outlet headers 47 may be top headers disposed at the top 51 of the chiller spaced above and distally to the support surface, or vice versa. An inlet manifold 46 fluidly couples the inlet headers 48 to the hot fluid flow conduit 42 receiving heated water from the condenser 23, and an outlet manifold 45 fluidly couples outlet headers 47 to the cold fluid flow conduit 41 returning cooled cooling water to the condenser. Manifold 46 bifurcates and distributes the heated cooling water flow to each inlet header 48. Manifold 45 collects and combines the cooled cooling water flow from each outlet header 47. A motorized fan or blower 44 is provided which draws ambient cooling air from the environment and discharges/blows the air upwards through the tube bundles 49 for cooling the cooling water. The headers 47 and 48 may each be considered section headers formed of individual sections of flow conduit such as piping which are physically coupled together.

Each cooling cell 54 of the air blast chiller 40 in one non-limiting embodiment may have a self-supporting triangular or A-frame construction and configuration with a broader bottom base or bottom 50 of the frame than top 51. The A-frame profile of a single cooling unit or cell may comprise two closely spaced proximate parallel outlet headers 47 at the apex of the A-frame and two laterally spaced apart and separated parallel inlet headers 48 at the bottom of the frame disposed distally to each other. The top and bottom headers 47, 48 are parallel to each other. The top outlet headers 47 in one configuration may be laterally spaced apart and closely adjacent as illustrated so that the top headers may be mechanically/structurally fastened together by any suitable fastening method (e.g. tie-plates, struts, etc.) to create a strong truss-like connection at the top. The bottom headers 48 are supported on a steel (or concrete) base frame 52 structure that may also support the blower 44, its motors, gear box and other ancillaries. This construction formed a self-supporting construction. Identical A-frame bundles or cells may be arrayed in a row, each fastened to its contiguous adjoining one via joints 53 located at the ends of each header both at the top and at the bottom. Joints 53 may comprise bolted piping flanges, welded piping connections, or a combination thereof. In one embodiment, bolted flanges are preferred.

Each cooling cell 54 of the air blast chiller 40 may be considered to comprise a first half section 55 including a first inlet header 48, a first outlet header 47, and a first tube bundle 49 comprising a plurality of linearly spaced apart heat transfer tubes 57 extending and fluidly coupled between the first inlet and outlet headers. A second half section 56 includes a second inlet header 48, a second outlet header 47, and a second tube bundle 49 also comprising a plurality of linearly spaced apart tubes 57 extending and fluidly coupled between the second inlet and outlet headers. In the A-frame construction, the first half section 55 is arranged angularly at an included acute angle A1 to the second half section 56. In one embodiment, angle A1 may be between 0 and 90 degrees, and in one non-limiting example may be about 60 degrees. Other angles may be used.

It will be appreciated that the first inlet bundle section header, first tube bundle, and first outlet bundle section header form a first cooling water flow circuit or path through the air blast chiller, and the second inlet bundle section header, second tube bundle, and second outlet bundle section header form a second cooling water flow circuit or path through the air blast chiller which is fluidly isolated from the first flow circuit or path in the cooling cell 54. Accordingly, the half sections 55 and 56 are fluidly isolated.

Advantageously, the air blast chiller half sections 55 and 56, each having a substantially flat profile when fabricated in the shop, allows the air blast chiller 44 to be shipped in multiple half section units to the installation site and then field assembled for form the A-frame. Multiple flat individual half sections 55, 56 each having a substantially flat profile comprised of an inlet header 48, tube bundle 49, and outlet header 47 may be horizontally or vertically stacked on a flat bed truck or rail car for shipment. This beneficially facilitates transportation and maneuvering the half sections to the specific erection location on site which in the case of retrofit installations may have serious space and access constrictions. The pair of top headers 47 may then be mechanically coupled together at the site in the manner described herein to erect the A-frame construction. It bears noting that in conventional air cooled condenser designs, this is not possible since brazing or welding of the tube bundles to the tube sheets of a single outlet header must typically be performed in the fabrication shop controlled environment conditions for leak proof joints. Accordingly, the A-frame arrangement must be shop fabricated and the cooler shipped to the installation site already in V-shaped condition, thereby making transport cumbersome and requiring larger field erection equipment. In addition, regional and local traffic laws governing the truck transport of oversize loads often requires additional and costly measures such as a flag vehicle and/or police escort to accompany the transport vehicle.

In alternative embodiments, it will be appreciated that the two cooling water outlet headers 47 may be replaced by a single outlet header having a longitudinally-extending vertical flow separation plate therein which maintains the flow isolation between the first and second cooling water flow circuits or paths. The separate cooling water flow paths whether created by either of the foregoing first and second half section arrangements helps maintain the desired high tubeside cooling water flow velocities with minimal friction loss in comparison to a single outlet header (not including the longitudinal flow separation plate) that allows the tube outlet flows to comingle instead of remaining isolated.

The tube bundles 49 in one embodiment may be shop manufactured straight tube bundles each comprised closely spaced apart parallel tubes 57 aligned in a linear row. Tubes 57 may have an obround or rectangular cross section and are brazed or welded at opposite ends to a tubesheet 60 of a header manifold 61 which is turn is fixedly attached to an to an inlet or outlet header 47, 48. Tubesheet 60 may be flat in one embodiment. The manifold 61 forms a transition of the flat tubesheet to the arcuately curved sidewalls of the headers 47, 48. Manifold 61 may be a generally rectilinear box-like configuration in one embodiment as illustrated with a bell shape in side view (reference FIG. 7) with a narrow end attached to header to avoid interference with the header coupling flanges at the joints 53 and the broader end containing the tube sheet. The tubesheet 60 may contain a plurality of tube penetrations which place the tubes 57 in fluid communication with their respective header manifold and header. In one embodiment, the tubes 57 may include heat transfer fins 58 attached to opposing flat sides 59 of the tubes in opposing directions. When the cooling cell 54 is assembled, the fins of one tube 57 preferably are very closely spaced to the fins of an adjoining tube to ensure airflow through the tubesheet 49 comes into maximum contact with the fins for optimum heat exchange and cooling of the cooling water.

Because of the stiffness of the rectangular tubes 57, the A-frame geometry is sufficiently self-supporting and rigid to meet the governing structural requirements (snow, wind & earthquake) at most sites. However, braces 63 and/or guy wires, frequently used to strengthen tall columns against winds and earthquakes, may be used to suitably brace the A-frame if required.

The design of the air blast chiller 40 as outlined above involves virtually no welding during site construction and erection. The erection of the chiller at the site is essentially a set of rigging, handling, and fastening steps that require no welding in one embodiment when bolted flanged joints 53 are employed, thus significantly reducing the cooling cell assembly time. Furthermore, because every tube bundle and inlet/outlet header assembly (i.e. half section) is installed by fastening, any damaged bundle (e.g. tornado, storm, or seismic damage) can be easily removed and replaced without affecting structurally sound bundle assemblies. Each cooling cell 54 in some constructions may be transported as a unit to the operating site and assembled to adjoining cells via connecting the bolted flanges of outlet and inlet headers 47, 48 described herein.

The headers, manifolds, tubes, flow conduits, and structural supports in one embodiment may preferably be made of an appropriate metallic material suitable for the service conditions.

In one embodiment, each A-frame cooling cell 54 may be served by a single blower 44 which supplies cooling air to the tube bundles 49. Thus a cell is composed of two multi-pass heat exchangers working in parallel which are cooled by blower 44. In other embodiments shown in FIG. 15, a larger single blower 44 may provided ambient cooling air to two or more cells. The cells 54 can be arranged in a tight packed array (see e.g. FIG. 12) so that the entire air blast chiller 40 has a rectangular footprint that is as small as possible. In effect, each cell is a pair of autonomous heat exchangers working in parallel with its counterparts in other cells to render the aggregate heat duty. As such, the cells do not all need to be assembled in a single tight array configuration. Rather, one or more group of cells can be arranged as a stand-alone air blast chiller sub-unit with other sub-units nearby. This ability to deploy the air blast chiller in such modular subunits gives the much needed layout flexibility at those existing operating sites where air blast chillers are to be retrofitted and the available yard space is limited or has an unusual or discontinuous configuration.

Figure 13:
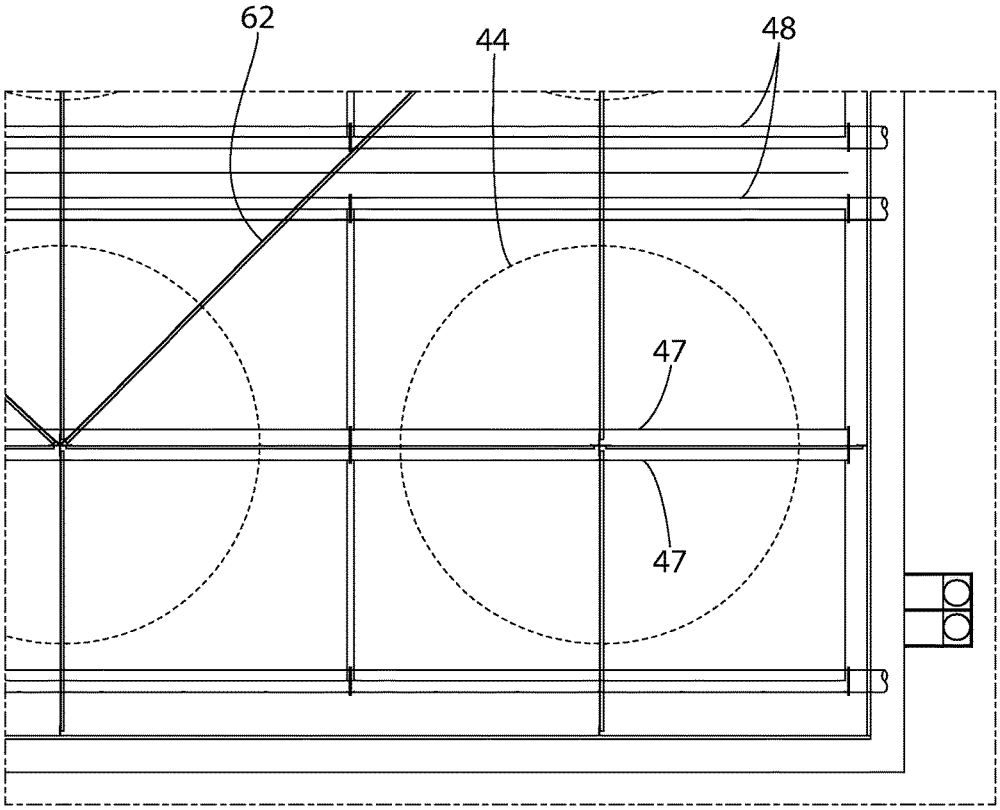
FIG. 13 is a detail taken from FIG. 12 of a cooling cell.
Figure 14:
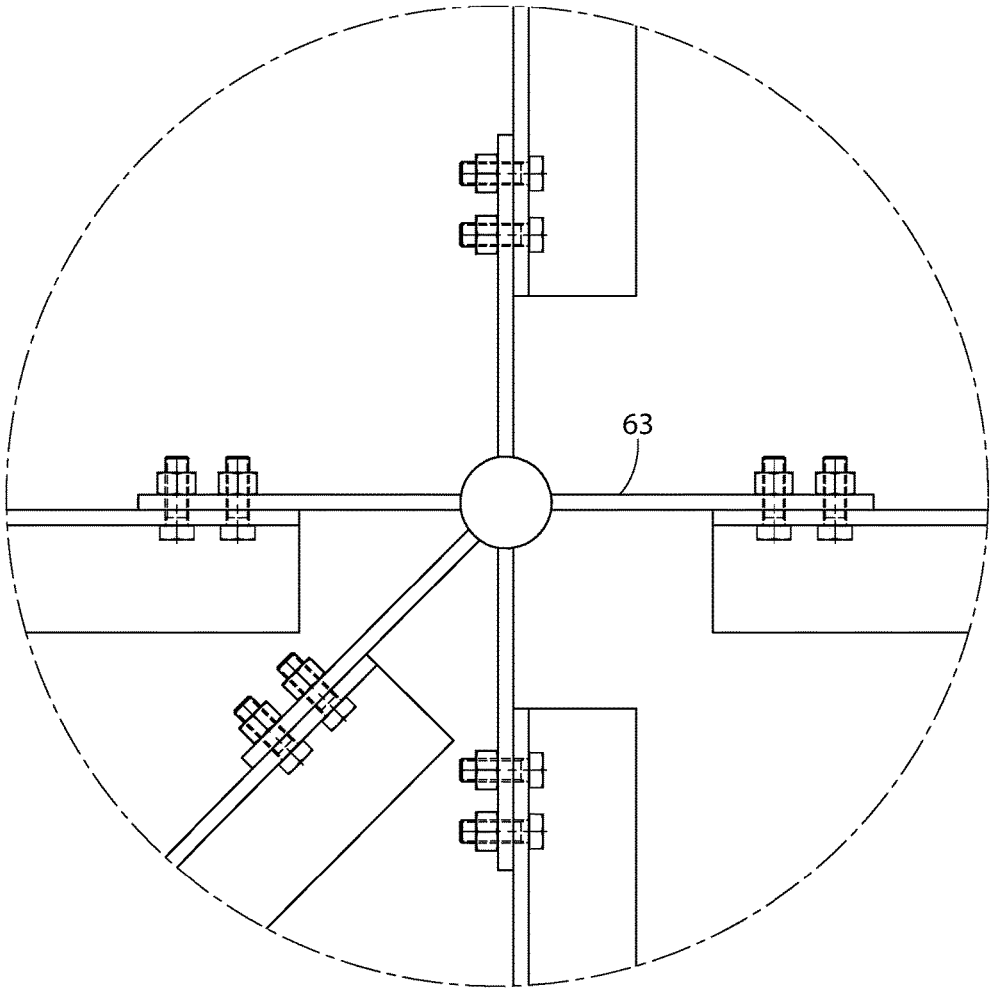
FIG. 14 is a detail taken from FIG. 12 showing a lateral support system and arrangement of the chiller.

Referring to FIGS. 12-14 showing a rectilinear array of cooling cells 54, the cells may be further structurally interconnected and laterally supported by a network of structural lateral braces 63 tied together to provide lateral stability to the array. The braces 63 help to resist wind and seismic loads on the array. Thus the A-frame is laterally restrained at the bottom by supports 52 (see, e.g. FIG. 2) and stayed by the braces 63 and/or guy wires attached to its top headers, if necessary, to withstand design basis wind and earthquake loads. Alternatively, a buttressing structure may be employed.

In some implementations shown in FIG. 11, the cooling cells 54 may be configured and arranged to form a multiple tubeside pass ("multi-pass") air blast chiller 40. The multiple passes obtains a well-developed turbulent regime inside the tubes to optimize heat transfer. Typically, four to eight passes may provide the optimal balance between the required pumping power of cooling water pump 66 and a sufficiently high flow velocity to maximize the overall heat transfer coefficient, and to prevent freezing up of water at sites located in cold climates.

As depicted in FIG. 11, a linear series of cooling cells 54 are arranged in end to end relationship as illustrated in which the inlet and outlet headers 48, 47 are all physically coupled together at the joints 53. To create the multi-pass flow pattern, however, not every set of inlet or outlet headers of each cell are in fluid communication in the adjoining inlet/outlet headers of an adjoining cell in order to create the cooling water flow pattern indicated by the directional flow arrows. Accordingly, the cooling water does not flow directly and in a linear path through either the inlet headers 48 or outlet headers 47 from one end of the array receiving heated cooling water to the other end of the array discharging chilled cooling water to the condenser 23. In one such non-limiting multi-pass arrangement as shown, a flow partition plate 63 may be installed at the joints 53 between the inlet headers 48 between passes 1 to 2, passes 3 to 4, and passes 5 to 6. Similarly, flow partition plates 64 may be installed at the joints between outlet headers 47 between passes 2 to 3 and passes 5 to 6. This arrangement causes the flow of cooling water to travel in both counterflow and co-flow with the blower cooling air which circulates upwards through the tube bundle array. The free ends of the outlet headers 47 at the ends of the array (not connected to an adjoining outlet header) may be closed by blind flanges 65 of another component to close the ends. In the tubeside multi-pass arrangement, some of the inlet and outlet headers 48, 47 according may reverse roles depending on the direction of the cooling water flow. As an example, the inlet headers 48 of pass 1 receive the heated cooling water from the hot fluid flow conduit 42 and condenser 23, while the inlet headers 48 of pass 6 act as outlet headers and are fluidly coupled to the cold fluid flow conduit 41 to return chilled water to the condenser. Other arrangement of flow partition plates and flow schemes may be used.

The ability to create multi-pass flow patterns provides considerable flexibility in the arrangement and configuration of the array. Advantageously, the tubeside multi-pass flow arrangement maximizes the amount of heat that may be extracted from the ambient cooling air delivered by the blower 44. In some embodiments, using limited quantities of conditioning water introduced as a fine mist spray in the inlet bell of the blower 44 during abnormally hottest hours in the summer would, in most cases, ameliorate the condenser pressure rise driving it to a plant's design basis value. Other methods of cooling augmentation during unusually high ambient temperature such as use of chilled water from another source such as a cooling tower or other can be used.

Various modifications of the air blast chiller 40 described herein may be made in various embodiments and implementation. For example, the two outlet header 47 configuration at the top 51 of the A-frame while preferred to maintain high tubeside flow velocities may nonetheless may be replaced with a single outlet header in some less preferred but acceptable embodiments dependent on the expected service conditions.

Figure 16:
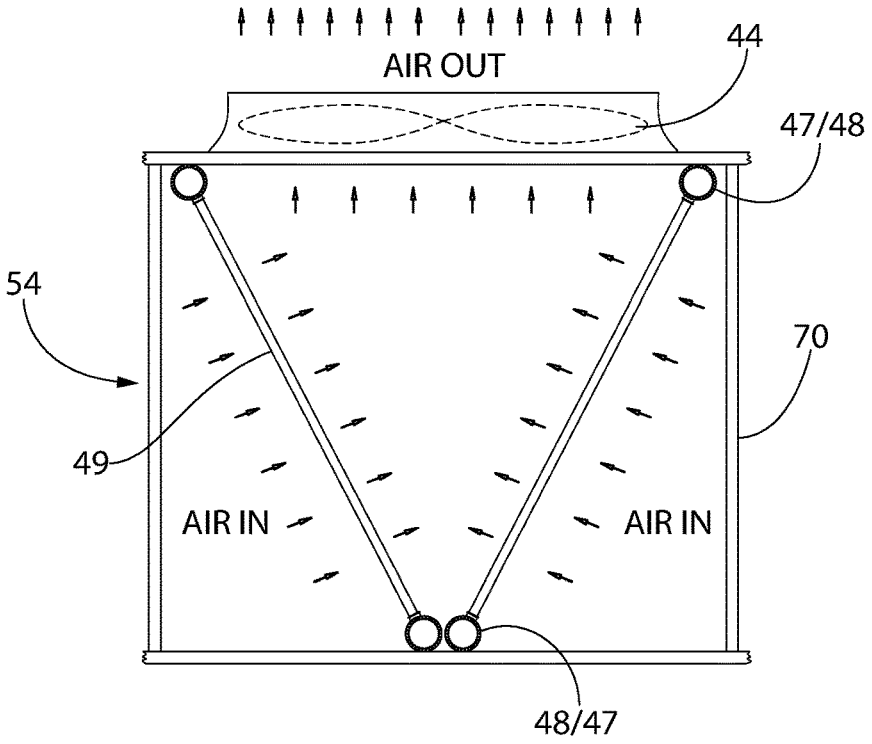
FIG. 16 is an alternative embodiment of a cooling cell having a V frame configuration.

In some embodiments contemplated, the tube bundles 49 of the cooling cell 54 may be instead be arranged in a V shape (see, e.g. FIG. 16) which is obverse of the A-frame shape illustrated and described above. In such an arrangement, a structural frame 70 may be necessary and provided to maintain and structurally stabilized the inverted V shape. The inlet and outlet headers 48/47 may be at the top or bottom of the cooling cell 54 depending on the flow direction selected. In the V shape arrangement, the fan 44 works by flow induction and is located at the top of the cooling cell to draw ambient cooling air inwards and upwards through the tube bundles 49 (see direction airflow arrows) in lieu of blasting cooling air directly through the bundles in the A-frame arrangement (compare FIG. 9). It bears noting that both the A frame or frame V advantageously shape reduces the system height requirements.

Figure 15:
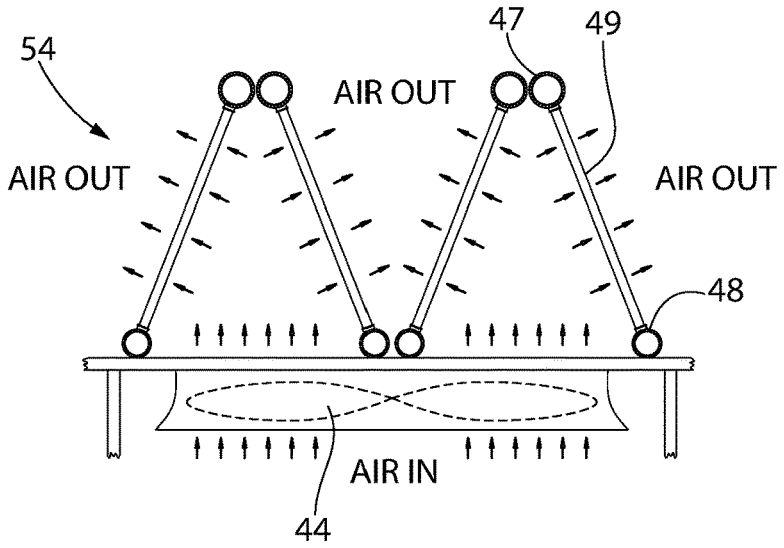
FIG. 15 is a side view of an alternative embodiment of cooling cell having double A frame configuration.

In another geometric variation, the single A-shape of a cooling cell 54 may be replaced by a double-A frame configuration as shown in FIG. 15. The four tube bundles 49 are cooled by a single cooling fan or blower 44 centrally positioned between each A frame. Because the four tube bundles provide the same tube cooling surface arear as two taller bundles in the single A frame arrangement, the double A frame will significantly reduce the bundle height and overall vertical clearance requirements which may be advantageous particularly for air blast chiller system retrofit installations for existing operating power plants. In some embodiments contemplated where available vertical clearance may vary across the installation site, a combination of single and double A frame cooling cells 54 may be used, thereby still providing the equivalent tube heat transfer surface area for the required cooling load.

The adoption of any of the above variations will be dictated by the site specific conditions, among them local wind patterns, earthquake resistance demands, size limitations of the air blast chiller, etc. The foregoing approaches provide significant design flexibility especially for retrofit air blast chiller installations.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A dry cooling system for condensing steam, the system comprising:

a condenser arranged to receive exhaust steam from a steam turbine;

a condenser tube bundle disposed in the condenser;

an air blast chiller fluidly coupled to the condenser tube bundle via a cooling water closed flow loop for circulating cooling water;

the air blast chiller comprising a plurality of fluidly interconnected cooling cells each comprising:

a pair of first and second inlet bundle section headers fluidly coupled to the closed flow loop;

a pair of first and second outlet bundle sections headers fluidly coupled to the closed flow loop;

a first tube bundle comprising a plurality of tubes fluidly coupled between the first inlet and outlet bundle section headers;

a second tube bundle angularly oriented to the first tube bundle and comprising a plurality of tubes fluidly coupled between the second inlet and outlet bundle section headers; and an air blower arranged to direct ambient cooling air through the first and second tube bundles;

wherein hot cooling water from the condenser tube bundle flows through the closed flow loop to each of the first and second inlet bundle section headers, through the first and second tube bundles wherein the cooling water is cooled, the cooled cooling water being collected in the first and second outlet bundle section headers and then flowing through the closed flow loop back to the condenser tube bundle;

wherein the plurality of cooling cells are arranged in a horizontally extending row in which first and second inlet bundle section headers are connected in a contiguous series to other first and second inlet bundle section headers respectively, and first and second outlet bundle section headers are connected in a contiguous series to other first and second outlet bundle section headers respectively;

wherein the first and second inlet bundle section headers are connected together via mating bolted flanges to adjoining first and second inlet bundle section headers respectively, and first and second outlet bundle section headers are connected together via mating bolted flanges to adjoining first and second outlet bundle section headers respectively.

2. The system according to claim 1, wherein the first and second tube bundles are arranged in a vertically-oriented triangular shape and converge towards a top of the cooling cell.

3. The system according to claim 2, wherein the first and second inlet bundle section headers are supported by a horizontal mounting surface, and the first and second outlet bundle section headers are mechanically coupled together to form a self-supporting A-frame construction.

4. The system according to claim 1, wherein the first inlet bundle section header, first tube bundle, and first outlet bundle section header form a first cooling water flow path, and the second inlet bundle section header, second tube bundle, and second outlet bundle section header form a second cooling water flow path fluidly isolated from the first flow path.

5. The system according to claim 1, wherein the cooling cells are configured and arranged to form a multiple pass heat exchanger in which:

cooling water cannot flow directly from one first inlet bundle section header into an adjoining first inlet bundle section header, and cooling water cannot flow directly from one first outlet bundle section header into an adjoining first outlet bundle section header; and cooling water cannot flow directly from one second inlet bundle section header into an adjoining second inlet bundle section header, and cooling water cannot flow directly from one second outlet bundle section header into an adjoining second outlet bundle section header.

6. The system according to claim 1, wherein the tubes include a plurality laterally extending heat transfer fins disposed on opposing sides of the tubes.

7. The system according to claim 6, wherein the tubes have an oblong cross sectional shape.

8. The system according to claim 1, further comprising an inlet manifold of the cooling water closed flow loop fluidly coupled to the first and second inlet bundle section headers at a first end of the first and second inlet bundle section headers, and a second end of the first and second inlet bundle section headers fluidly coupled to an outlet manifold of the cooling water closed flow loop.

9. A dry cooling system for condensing steam, the system comprising:

a condenser arranged to receive exhaust steam from a steam turbine;

a condenser tube bundle disposed in the condenser;

an air blast chiller fluidly coupled to the condenser tube bundle via a cooling water closed flow loop for circulating cooling water;

the air blast chiller comprising a plurality of fluidly interconnected cooling cells each comprising:

a pair of first and second inlet bundle section headers fluidly coupled to the closed flow loop;

a pair of first and second outlet bundle sections headers fluidly coupled to the closed flow loop;

a first tube bundle comprising a plurality of tubes fluidly coupled between the first inlet and outlet bundle section headers;

a second tube bundle angularly oriented to the first tube bundle and comprising a plurality of tubes fluidly coupled between the second inlet and outlet bundle section headers; and an air blower arranged to direct ambient cooling air through the first and second tube bundles;

wherein hot cooling water from the condenser tube bundle flows through the closed flow loop to each of the first and second inlet bundle section headers, through the first and second tube bundles wherein the cooling water is cooled, the cooled cooling water being collected in the first and second outlet bundle section headers and then flowing through the closed flow loop back to the condenser tube bundle;

wherein the plurality of cooling cells are arranged in a horizontally extending row in which first and second inlet bundle section headers are connected in a contiguous series to other first and second inlet bundle section headers respectively, and first and second outlet bundle section headers are connected in a contiguous series to other first and second outlet bundle section headers respectively;

wherein the cooling cells are arranged in pairs in which the first and second inlet bundle section headers of a first cell are fluidly isolated from the first and second inlet bundle section headers of a second cell respectively, and the first and second outlet bundle section headers of the first cell fluidly communicate with the first and second outlet bundle section headers of a second cell respectively.

10. The system according to claim 9, wherein the first and second inlet bundle section headers of each pair of cooling cells are in fluid communication with the first and second inlet bundle section headers of an adjoining pair of cooling cells, and the first and second outlet bundle section headers of each pair of cooling cells are not in fluid communication with the first and second inlet bundle section headers of an adjoining pair of cooling cells.

11. An air blast chiller for condensing steam, the air blast chiller comprising:

a plurality of fluidly coupled cooling cells arranged in a contiguous row of adjoining fluidly interconnected cooling cells, each cooling cell comprising:

a first half section including a first inlet header, a first outlet header, and a first tube bundle comprising a plurality of linearly spaced apart finned tubes fluidly coupled between the first inlet and outlet headers; and a second half section including a second inlet header, a second outlet header, and a second tube bundle comprising a plurality of linearly spaced apart finned tubes fluidly coupled between the second inlet and outlet headers;

the first half section arranged at an acute angle to the second half section wherein the first and second outlet headers are disposed proximately to each other, and the first and second inlet headers are disposed distally to each other forming a triangular configuration; and a blower arranged and operable to flow ambient cooling air through the first and second tube bundles;

wherein at least some of the cooling cells are arranged in a pair in which the inlet headers of a first and second cooling cell are mechanically coupled together via joints which includes a flow partition plate that prevents cooling water from flowing directly from the inlet headers of the first cooling cell into corresponding inlet headers of the second cooling cell.

12. The air blast chiller according to claim 11, wherein the first and second outlet headers are disposed laterally adjacent to each other and mechanically coupled together to form a self-supporting integrated construction.

13. The air blast chiller according to claim 11, wherein the outlet headers of the first and second cooling cells are mechanically coupled together via joints configured to allow cooling water to flow directly from the outlet headers of the first cooling cell into corresponding outlet headers of the second cooling cell.

14. The air blast chiller according to claim 11, wherein a first pair of cooling cells is fluidly coupled to an adjoining second pair of cooling cells in which inlet headers of the first pair are fluidly isolated from inlet headers of the second pair, and outlet headers of the first pair are fluidly coupled to the outlet headers of the second pair.

15. The air blast chiller according to claim 14, wherein the first and second pairs of cooling cells form a 4-pass cooling water flow arrangement.

16. The air blast chiller according to claim 11, wherein the cooling cells each have an A frame configuration with the first and second inlet headers forming a bottom of the cell and the first and second outlet headers forming a top apex of the cell.

17. The air blast chiller according to claim 11, wherein the cooling cells each have a V frame configuration with the first and second inlet headers forming a top of the cell and the first and second outlet headers forming a bottom apex of the cell.

18. A method for condensing steam, the method comprising:

providing the air blast chiller according to claim 11;

receiving hot cooling water from a steam condenser in the first and second inlet headers of a first cooling cell;

flowing the cooling water through the first and second tube bundles in a first direction, wherein the cooling water is cooled a first time;

collecting the cooling water in the first and second outlet headers of the first cooling cell;

transferring the cooling water to the first and second outlet headers of a second cooling cell;

flowing the cooling water through the first and second tube bundles of the second cooling cell in a second first direction opposite the first direction, wherein the cooling water is cooled a second time;

collecting the cooling water in the first and second inlet headers of the second cooling cell; and transferring the cooling water to the first and second inlet headers of a third cooling cell.

19. An air blast chiller for condensing steam, the air blast chiller comprising:

a plurality of fluidly coupled cooling cells arranged in a contiguous row of adjoining fluidly interconnected cooling cells, each cooling cell comprising:

a first half section including a first inlet header, a first outlet header, and a first tube bundle comprising a plurality of linearly spaced apart finned tubes fluidly coupled between the first inlet and outlet headers; and a second half section including a second inlet header, a second outlet header, and a second tube bundle comprising a plurality of linearly spaced apart finned tubes fluidly coupled between the second inlet and outlet headers;

the first half section arranged at an acute angle to the second half section wherein the first and second outlet headers are disposed proximately to each other, and the first and second inlet headers are disposed distally to each other forming a triangular configuration; and a blower arranged and operable to flow ambient cooling air through the first and second tube bundles;

wherein at least one cooling cell has a double A-frame construction comprising:

a third half section including a third inlet header, a third outlet header, and a third tube bundle comprising a plurality of linearly spaced apart finned tubes fluidly coupled between the third inlet and outlet headers; and a fourth half section including a fourth inlet header, a fourth outlet header, and a fourth tube bundle comprising a plurality of linearly spaced apart finned tubes fluidly coupled between the fourth inlet and outlet headers;

the third half section arranged at an acute angle to the fourth half section wherein the third and fourth outlet headers are disposed proximately to each other, and the third and fourth inlet headers are disposed distally to each other forming a second triangular configuration;

the blower being located centrally between second and third half sections.

* * * * *